US010211570B2

(12) United States Patent
Tanaka et al.

(10) Patent No.: US 10,211,570 B2
(45) Date of Patent: Feb. 19, 2019

(54) LEVER-FITTING TYPE CONNECTOR

(71) Applicant: Yazaki Corporation, Tokyo (JP)

(72) Inventors: Masahiro Tanaka, Shizuoka (JP); Hiroaki Imai, Shizuoka (JP); Hajime Kato, Shizuoka (JP); Shigeru Tanaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/960,536

(22) Filed: Apr. 23, 2018

(65) Prior Publication Data

US 2018/0316134 A1 Nov. 1, 2018

(30) Foreign Application Priority Data

Apr. 27, 2017 (JP) ..... 2017-088833

(51) Int. Cl.
*H01R 13/629* (2006.01)
*H01R 13/627* (2006.01)
*H01R 13/621* (2006.01)

(52) U.S. Cl.
CPC ..... *H01R 13/62938* (2013.01); *H01R 13/621* (2013.01); *H01R 13/6273* (2013.01); *H01R 13/62955* (2013.01)

(58) Field of Classification Search
CPC ..... H01R 13/62938; H01R 13/62933; H01R 13/62955; H01R 13/62988
USPC ..... 439/157
See application file for complete search history.

(56) References Cited

U.S. PATENT DOCUMENTS 5,913,691 A * 6/1999 Clark ..... H01R 13/641 439/157
6,325,648 B1 * 12/2001 Bilezikjian ..... H01R 13/62938 439/157
6,982,393 B2 * 1/2006 Matsui ..... H01R 13/62933 200/332
7,044,758 B2 * 5/2006 Deno ..... H01R 13/62955 439/157
7,438,570 B2 * 10/2008 Mori ..... H01R 13/62933 439/157

(Continued)

FOREIGN PATENT DOCUMENTS

JP 2005-11647 A 1/2005
JP 2007-149420 A 6/2007

*Primary Examiner* — Hae Moon Hyeon
*Assistant Examiner* — Peter G Leigh
(74) *Attorney, Agent, or Firm* — Kenealy Vaidya LLP

(57) ABSTRACT

A lever-fitting type connector includes a lever configured to linearly perform a relative movement with respect to a terminal accommodation member when lever operational force in a straight direction is input, a first guide mechanism configured to convert lever input acting along a lever operation direction that is exerted from the lever on the terminal accommodation member, into force in a connector insertion-removal direction orthogonal to the lever operation direction, and to guide a relative movement between the terminal accommodation member and the lever while performing conversion of a direction of the force, and a second guide mechanism that is a screw mechanism that can exert axial force acting along the lever operation direction, on the lever, and is configured to relatively move the lever with respect to the electrically-connected target object while guiding in the lever operation direction.

16 Claims, 13 Drawing Sheets

(56) References Cited

U.S. PATENT DOCUMENTS

| | | | | |
|---|---|---|---|---|
| 7,442,058 | B2 * | 10/2008 | Ohtaka | H01R 13/6272 439/157 |
| 7,872,206 | B2 * | 1/2011 | Matsunaga | H01H 9/085 200/335 |
| 7,934,939 | B2 * | 5/2011 | Chen | H01R 13/639 439/352 |
| 8,303,320 | B2 * | 11/2012 | Loncar | H01R 13/516 439/157 |
| 8,379,375 | B2 * | 2/2013 | Furuya | B60L 3/0069 200/17 R |
| 8,992,239 | B2 * | 3/2015 | Furuya | H01R 13/62905 439/157 |
| 9,130,324 | B2 * | 9/2015 | Furuya | H01R 24/005 |
| 2017/0110830 | A1 * | 4/2017 | Yamada | H01R 13/62938 |

* cited by examiner

LEVER-FITTING TYPE CONNECTOR

CROSS-REFERENCE TO RELATED APPLICATION(S)

The present application claims priority to and incorporates by reference the entire contents of Japanese Patent Application No. 2017-088833 filed in Japan on Apr. 27, 2017.

BACKGROUND OF THE INVENTION

1. Field of the Invention

The present invention relates to a lever-fitting type connector.

2. Description of the Related Art

There has been conventionally known a lever-fitting type connector including a terminal accommodation member such as a housing that includes a connector fitting portion, a lever that can relatively move with respect to the terminal accommodation member, and a fitting operational force conversion mechanism that converts force acting on the terminal accommodation member from the lever according to lever operational force, into force in a connector insertion-removal direction. The fitting operational force conversion mechanism reduces fitting operational force (lever operational force) exerted when the connector fitting portion is fitted with a counterpart fitting portion of a counterpart connector, and includes portions provided between the lever and the terminal accommodation member, and a counterpart connector side. For example, Japanese Patent Application Laid-open No. 2007-149420 and Japanese Patent Application Laid-open No. 2005-11647 described below disclose a so-called LIF connector that fits a connector fitting portion with a counterpart fitting portion by rotationally operating a lever with respect to a terminal accommodation member, and converting rotational operational force incidental to the rotational operation, into linear force in a connector insertion-removal direction.

Meanwhile, in a lever-fitting type connector of this type, the connector fitting portion is fitted with the counterpart fitting portion while the rotational operational force being converted into the linear force. It is therefore necessary to provide a clearance gap necessary for a fitting operation, between the connector fitting portion and the counterpart fitting portion. Thus, the conventional lever-fitting type connector has room for improvement for achieving miniaturization.

SUMMARY OF THE INVENTION

A purpose of the present invention is to provide a lever-fitting type connector that can miniaturize a physical size.

In order to achieve the above object, a lever-fitting type connector according to one aspect of the invention includes a terminal accommodation member including a terminal accommodation unit accommodating a terminal serving as a target of fitting with a counterpart terminal of a counterpart connector in an electrically-connected target object, and a connector fitting portion to be fitted with a counterpart fitting portion of the counterpart connector, a lever configured to linearly perform a relative movement with respect to the terminal accommodation member when lever operational force in a straight direction is input, a first guide mechanism configured to convert lever input acting along a lever operation direction that is exerted from the lever on the terminal accommodation member, into force in a connector insertion-removal direction orthogonal to the lever operation direction, and to guide a relative movement between the terminal accommodation member and the lever while performing conversion of a direction of the force; and a second guide mechanism that is a screw mechanism that can exert axial force acting along the lever operation direction, on the lever, and is configured to relatively move the lever with respect to the electrically-connected target object while guiding in the lever operation direction, when exerting the axial force on the lever in a state in which the connector fitting portion and the counterpart fitting portion are inserted.

According to another aspect of the present invention, in the lever-fitting type connector, the second guide mechanism may be configured to fix the lever to the electrically-connected target object in conjunction with completion of guiding of the lever with respect to the electrically-connected target object, and the first guide mechanism may be configured to complete fitting between the connector fitting portion and the counterpart fitting portion when guiding of the lever that is performed by the second guide mechanism is completed.

According to still another aspect of the present invention, in the lever-fitting type connector, the first guide mechanism may include a guided portion provided on one of the terminal accommodation member and the lever, and a guiding portion that is provided on another one thereof and guides the guided portion while converting force in the lever operation direction that acts with the guided portion into force in an orthogonal direction of the lever operation direction.

According to still another aspect of the present invention, in the lever-fitting type connector, the second guide mechanism may include a male screw provided on one of the lever and the electrically-connected target object in a state in which an axis line extends along the lever operation direction, and a female screw provided on another one thereof and to be screwed with the male screw.

According to still another aspect of the present invention, in the lever-fitting type connector, the lever-fitting type connector may include an orientation holding mechanism for holding an orientation with the counterpart connector at a time of connector insertion and removal with respect to the counterpart connector in the connector insertion-removal direction, and the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a lever-fitting type connector according to the present invention will be described in detail below based on the drawings. In addition, the present invention is not limited by the embodiment.

Embodiment

One of embodiments of the lever-fitting type connector according to the present invention will be described based on FIGS. 1 to 13.

Figure 1:
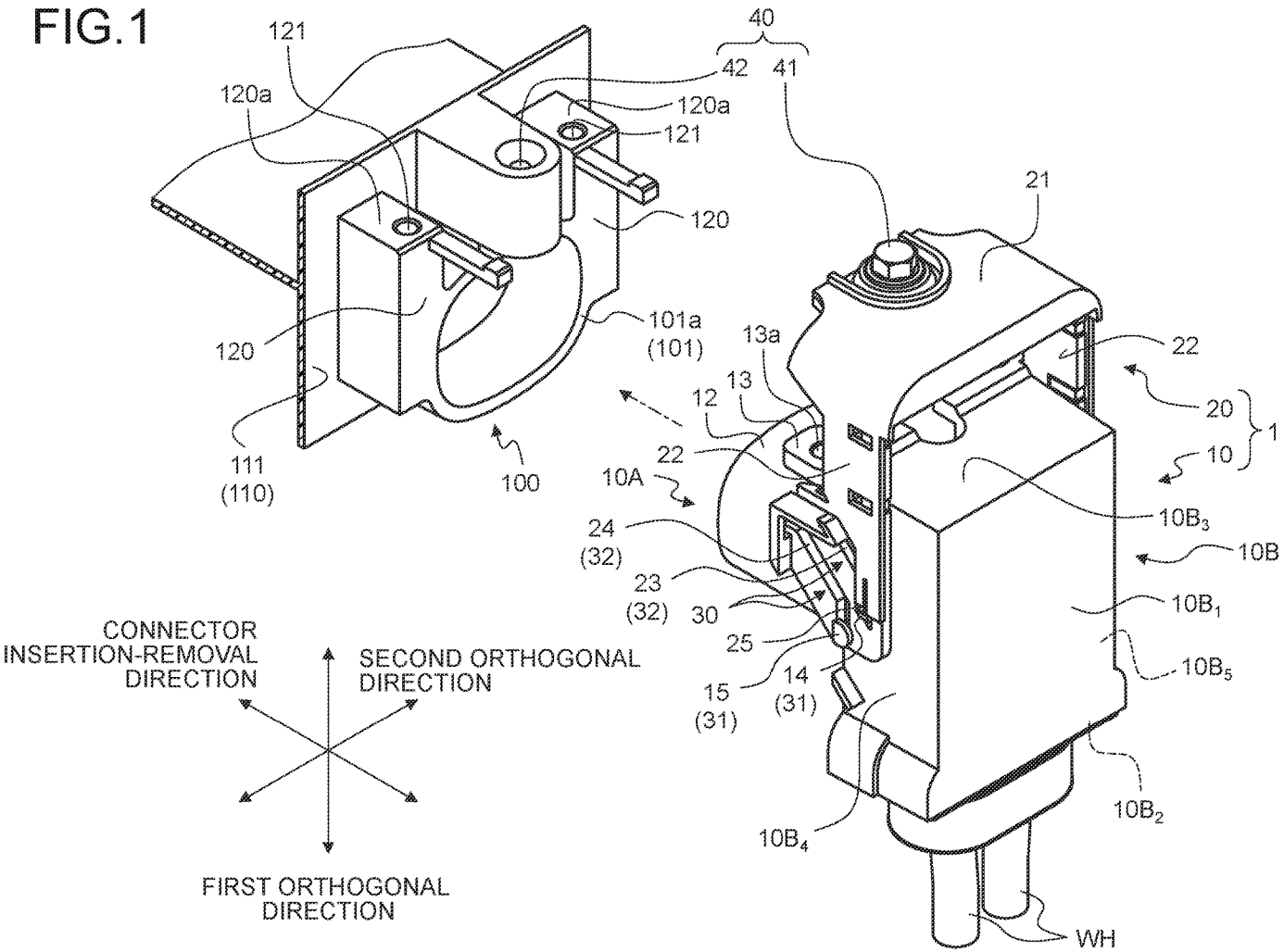
FIG. 1 is a perspective view illustrating a lever-fitting type connector of an embodiment, and is a diagram illustrating a state before the lever-fitting type connector is attached to a counterpart connector.
Figure 2:
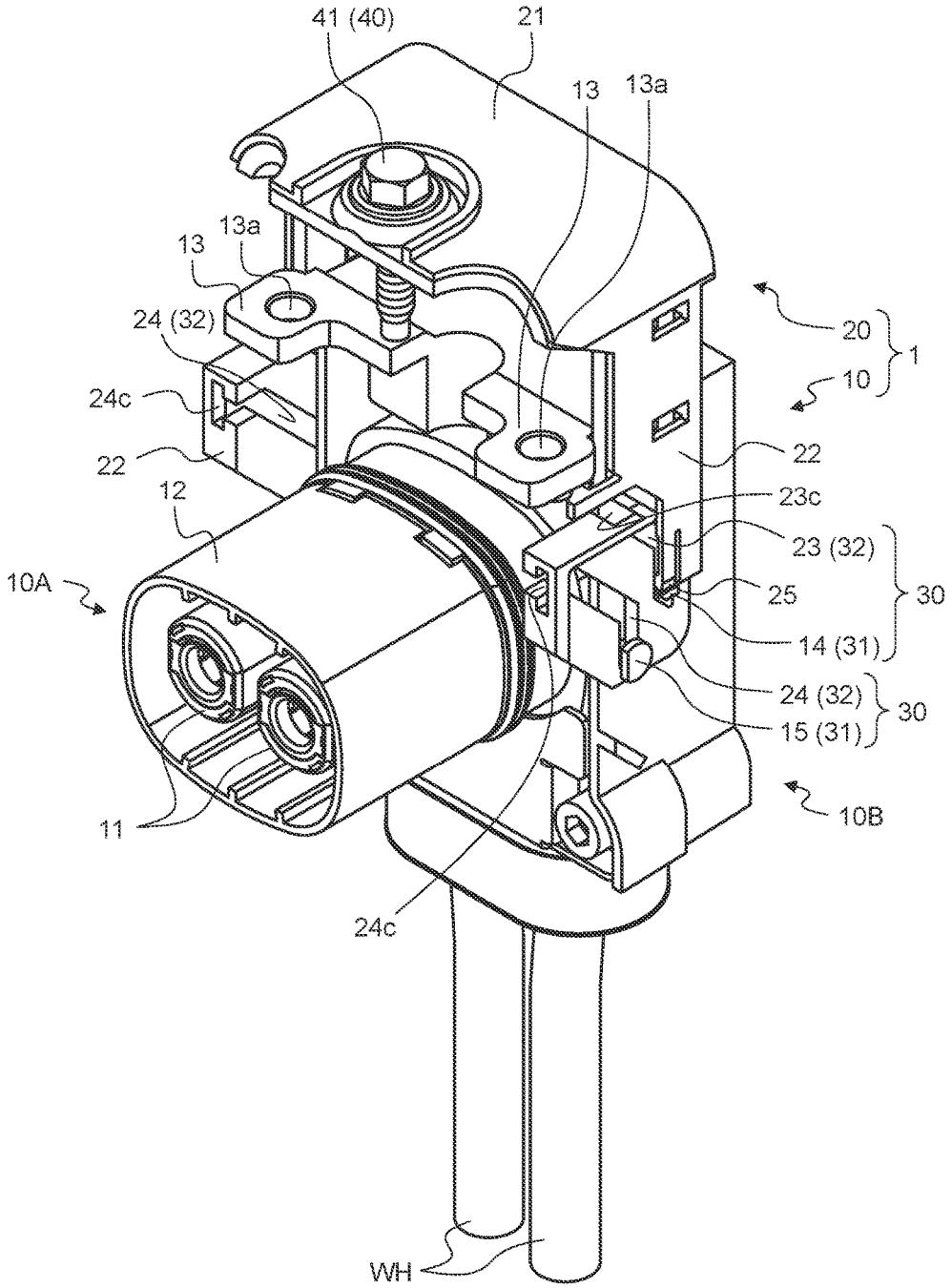
FIG. 2 is a perspective view of the lever-fitting type connector viewed from a connector fitting portion side, and is a diagram illustrating default positions of a terminal accommodation member and a lever.
Figure 3:
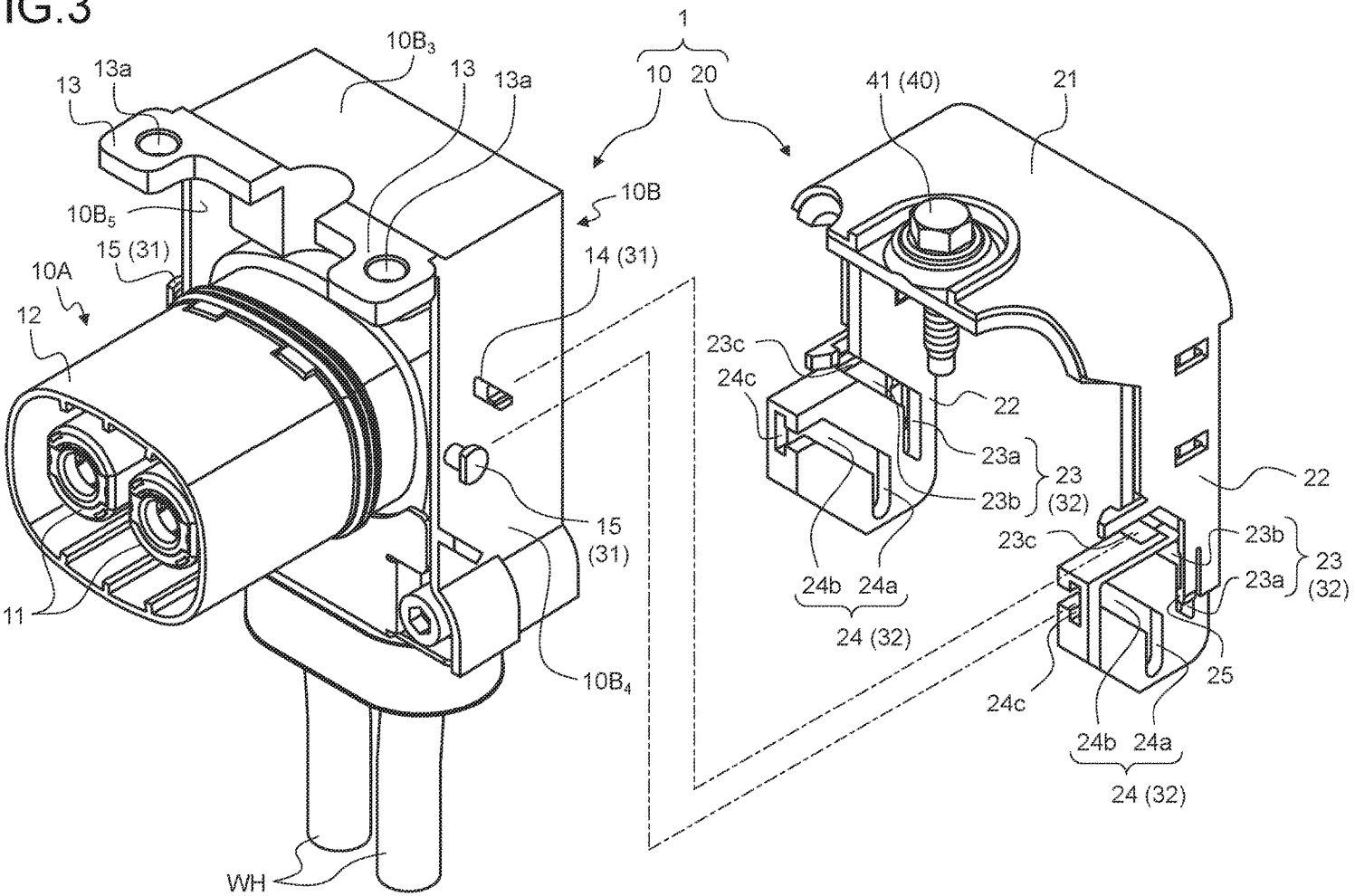
FIG. 3 is an exploded perspective view of the terminal accommodation member and the lever.

A sign 1 in FIGS. 1 to 3 denotes a lever-fitting type connector of the present embodiment. The lever-fitting type connector 1 is physically and electrically connected with a counterpart connector 100 serving as a fitting target, and includes a terminal (not illustrated), a terminal accommodation member 10 in which the terminal is accommodated, and a lever 20 that reduces fitting operational force exerted when the lever-fitting type connector 1 is fitted with the counterpart connector 100.

The counterpart connector 100 is included in a device (hereinafter, referred to as an "electrically-connected target object") 110 serving as a target of electrical connection via the lever-fitting type connector 1, and is provided on a casing 111 or the like of the electrically-connected target object 110 (FIG. 1). The electrically-connected target object 110 may be any object as long as the object serves as a target of electrical connection via the lever-fitting type connector 1. Here, a drive device of a vehicle (e.g., an electrical motor, an inverter, or the like of an electrical vehicle or a hybrid vehicle) is used as an example of the electrically-connected target object 110. The counterpart connector 100 includes a housing 101 provided on the casing 111 of the electrically-connected target object 110, and a counterpart terminal (not illustrated) is disposed inside a fitting portion (hereinafter, referred to as a "counterpart fitting portion") 101*a* of the housing 101.

In the lever-fitting type connector 1, the terminal serves as a target of fitting with the counterpart terminal, and physical and electrical mutual connection relationship is constructed according to the fitting. The terminal may be a male terminal or a female terminal.

The terminal accommodation member 10 includes a terminal accommodation unit 11 (FIGS. 2 and 3) in which the terminal is accommodated, and a fitting portion (hereinafter, referred to as a "connector fitting portion") 12 (FIGS. 1 to 3) to be fitted with the counterpart fitting portion 101*a*. The terminal accommodation unit 11 is disposed inside the connector fitting portion 12. In this exemplification, the connector fitting portion 12 and the counterpart fitting portion 101*a* are both formed in cylindrical shapes, and are fitted with each other along cylindrical axes. The terminal and the counterpart terminal are thereby fitted, and physical and electrical connection between the lever-fitting type connector 1 and the counterpart connector 100 is established. In the terminal accommodation member 10, an electrical wire WH physically and electrically connected to the internal terminal is laid out to the outside. In this exemplification, the electrical wire WH is laid out in an intersecting direction of an insertion-removal direction between the connector fitting portion 12 and the counterpart fitting portion 101*a* (hereinafter, referred to as a "connector insertion-removal direction"). Here, the electrical wire WH is laid out in an orthogonal direction of the connector insertion-removal direction, and the orthogonal direction will be hereinafter referred to as a "first orthogonal direction" (FIG. 1). In addition, an orthogonal direction of the connector insertion-removal direction and the first orthogonal direction will be hereinafter referred to as a "second orthogonal direction".

After fitting completion of the connector fitting portion 12 and the counterpart fitting portion 101*a*, the lever-fitting type connector 1 is fixed to the electrically-connected target object 110. The fixing is performed by a fixed portion 13 (FIGS. 1 to 3) provided in the terminal accommodation member 10, and a fixing portion 120 (FIG. 1) that is a counterpart to which the fixed portion 13 is fixed, and is provided in the electrically-connected target object 110. The fixing portion 120 is provided on the casing 111 or the housing 101 of the counterpart connector 100 in the electrically-connected target object 110, for example.

For example, the fixing portion 120 is formed as a protruding member protruding from the casing 111 toward the lever-fitting type connector 1 side in a cylindrical axis direction (connector insertion-removal direction) of the counterpart fitting portion 101*a*, and is disposed at each of two locations so as to sandwich the counterpart fitting portion 101*a* therebetween in the orthogonal direction of the cylindrical axis direction. The fixed portion 13 is provided for each of the fixing portions 120 in accordance with a position to be set after the completion of fitting with the fixing portions 120. The fixed portions 13 and the fixing portions 120 are formed so that respective planes are overlapped after the fitting completion, and have respective hole portions 13*a* and 121 concentrically disposed after the fitting completion.

The fixed portions 13 and the fixing portions 120 are fixed by screwing using co-fastening screws each including a male screw and a female screw. For example, the co-fastening screw may be made of a combination of a male screw member and a female screw member, and may be made of either screw member of female and male screw members, and a screw portion of a co-fastening target to be screwed with the screw member. In the case of using a male screw member and a female screw member as in the former, for example, each of the hole portions 13*a* and 121 is formed as a circular through-hole, the male screw member is inserted into each of the hole portions 13*a* and 121, and the female screw member is screwed with the male screw member. The fixed portion 13 and the fixing portion 120 are thereby fixed. On the other hand, in the latter case, a female screw portion is formed on an inner circumferential wall of any one of the circular hole portions 13*a* and 121, and the male screw member inserted into the other one thereof is screwed with the female screw portion. The fixed portion 13 and the fixing portion 120 are thereby fixed.

In this exemplification, the latter is exemplified (FIGS. 11 and 12), and the fixing portion 120 is provided on the casing 111, and as mentioned later, the fixed portion 13 is provided on a shield shell 10B. Here, the fixing portions 120 are disposed so that the counterpart fitting portion 101*a* is positioned therebetween in the second orthogonal direction, and a female screw portion (not illustrated) is formed on an inner circumferential wall of the circular hole portion 121 of the fixing portions 120 that has an axis line direction corresponding to the first orthogonal direction. In addition, each of the fixed portions 13 is formed into a rectangular piece shape so that planes are overlapped in the first orthogonal direction after the fitting completion with respect to end surfaces (end surfaces disposed on the side of an insertion port to the hole portions 121 of male screw members B) 120*a* of the fixing portions 120, and the hole portion 13*a* having an axis line direction corresponding to the thickness direction (first orthogonal direction) is formed as a circular through-hole.

More specifically, the terminal accommodation member 10 of this exemplification is prepared as an integrated structure in which a housing 10A and the shield shell 10B are assembled to each other.

The housing 10A is formed of insulating material such as synthetic resin, and the terminal accommodation unit 11 and the connector fitting portion 12 are provided (FIGS. 1 to 3). The shield shell 10B is provided so as to cover the housing 10A from the outside for protection against noise, and is formed of electrically-conductive material such as metal. The fixed portion 13 is only required to be provided on at least one of the housing 10A and the shield shell 10B. In this exemplification, the fixed portions 13 are provided on the shield shell 10B (FIGS. 1 to 4).

Figure 4:
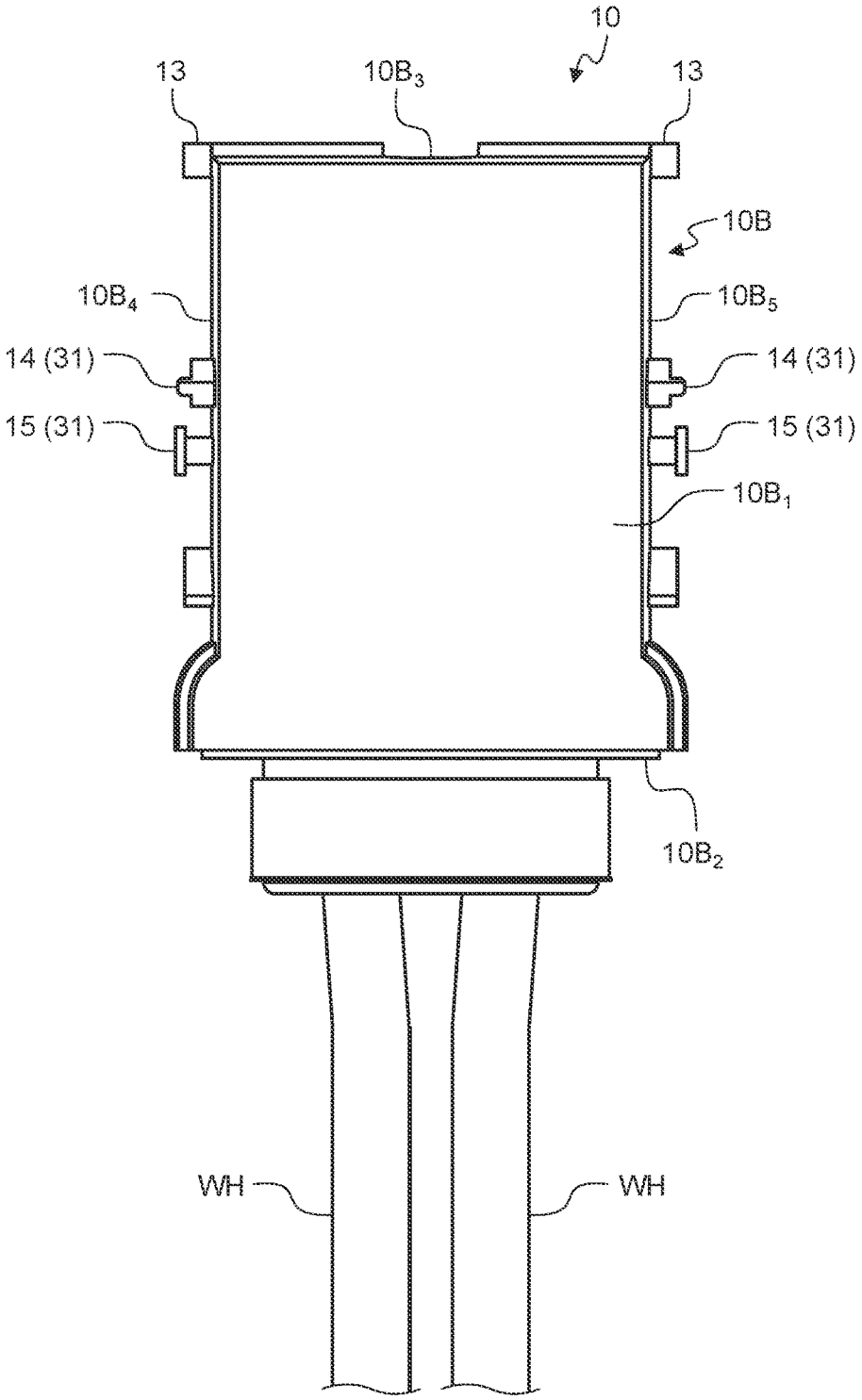
FIG. 4 is a plan view of the terminal accommodation member viewed from a base wall side of a shield shell.

In the terminal accommodation member 10 of this exemplification, the shield shell 10B is formed so as to have a parallelepiped box shape, and the housing 10A is disposed inside the shield shell 10B. Nevertheless, in the housing 10A, the terminal accommodation unit 11 and the connector fitting portion 12 protrude from the inside to the outside of the shield shell 10B. The shield shell 10B includes a substantially-rectangular base wall 10$B_1$, and four vertical walls 10$B_2$ to 10$B_5$ respectively provided on four sides of the base wall 10$B_1$ (FIGS. 1 and 4). In the shield shell 10B, the vertical wall 10$B_2$ and the vertical wall 10$B_3$ face each other in the first orthogonal direction, the electrical wire WH is laid out from the one vertical wall 10$B_2$, and the fixed portion 13 protrudes from the other vertical wall 10$B_3$. In addition, in the shield shell 10B, the vertical wall 10$B_4$ and the vertical wall 10$B_5$ face each other in the second orthogonal direction.

The lever 20 is formed of insulating material such as synthetic resin. The lever 20 is attached to the terminal accommodation member 10, and when lever operational force in a straight direction is input through an operation (lever operation) of a worker or the like, exerts lever input acting along a set lever operation direction, on the terminal accommodation member 10, and relatively moves linearly with respect to the terminal accommodation member 10. As the lever operation direction, a first lever operation direction in which the lever 20 is linearly brought close to the terminal accommodation member 10, and a second lever operation direction which is an opposite direction of the first lever operation direction, and in which the lever 20 is linearly moved away from the terminal accommodation member 10 are set. In addition, the lever 20 is attached to the terminal accommodation member 10 via a first guide mechanism 30 to be mentioned later, and relatively moves with respect to the terminal accommodation member 10 in a direction intersecting with the lever operation direction.

The lever 20 of this exemplification is formed into a U-shape having a base wall 21, and two vertical walls 22 protruding in the same direction from two facing sides of the base wall 21 (FIGS. 1 to 3). The lever 20 is disposed so that the base wall 21 and the two vertical walls 22 surround the shield shell 10B from the outside, and is attached to the shield shell 10B. When the lever 20 is attached to the terminal accommodation member 10, in the lever 20, a wall surface of the base wall 21 faces a wall surface of the vertical wall 10$B_3$ of the shield shell 10B, a wall surface of one vertical wall 22 faces a wall surface of the vertical wall 10$B_4$ of the shield shell 10B, and a wall surface of the other vertical wall 22 faces a wall surface of the vertical wall 10$B_5$ of the shield shell 10B. In this exemplification, by the first guide mechanism 30 interposed between the one vertical wall 22 and the vertical wall 10$B_4$ of the shield shell 10B, and the first guide mechanism 30 interposed between the other vertical wall 22 and the vertical wall 10$B_5$ of the shield shell 10B, the lever 20 is attached in a state of being relatively movable with respect to the shield shell 10B. In the lever 20, the first orthogonal direction is set as the lever operation direction, and lever operational force is input to the base wall 21.

Figure 5:
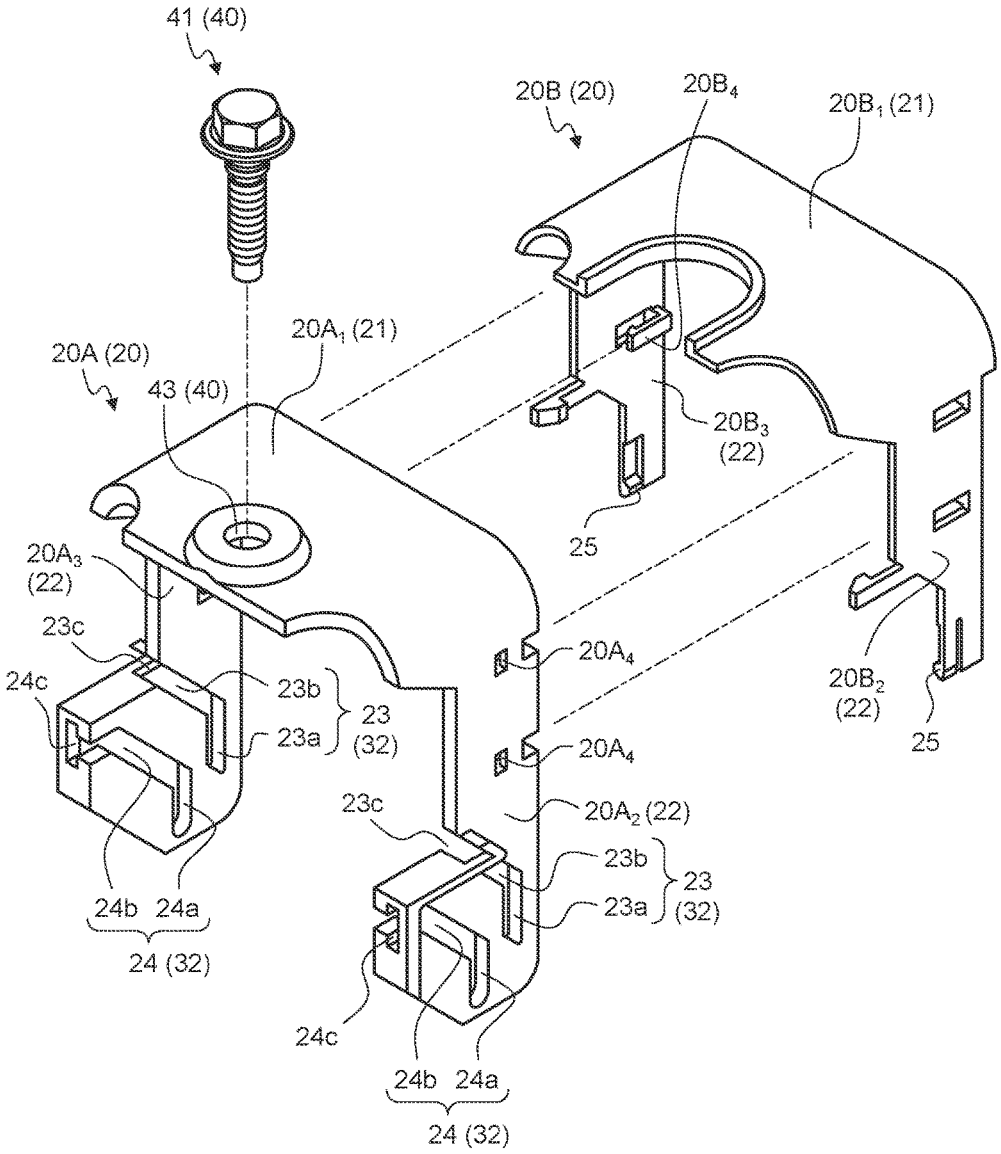
FIG. 5 is an exploded perspective view of the lever.
Figure 6:
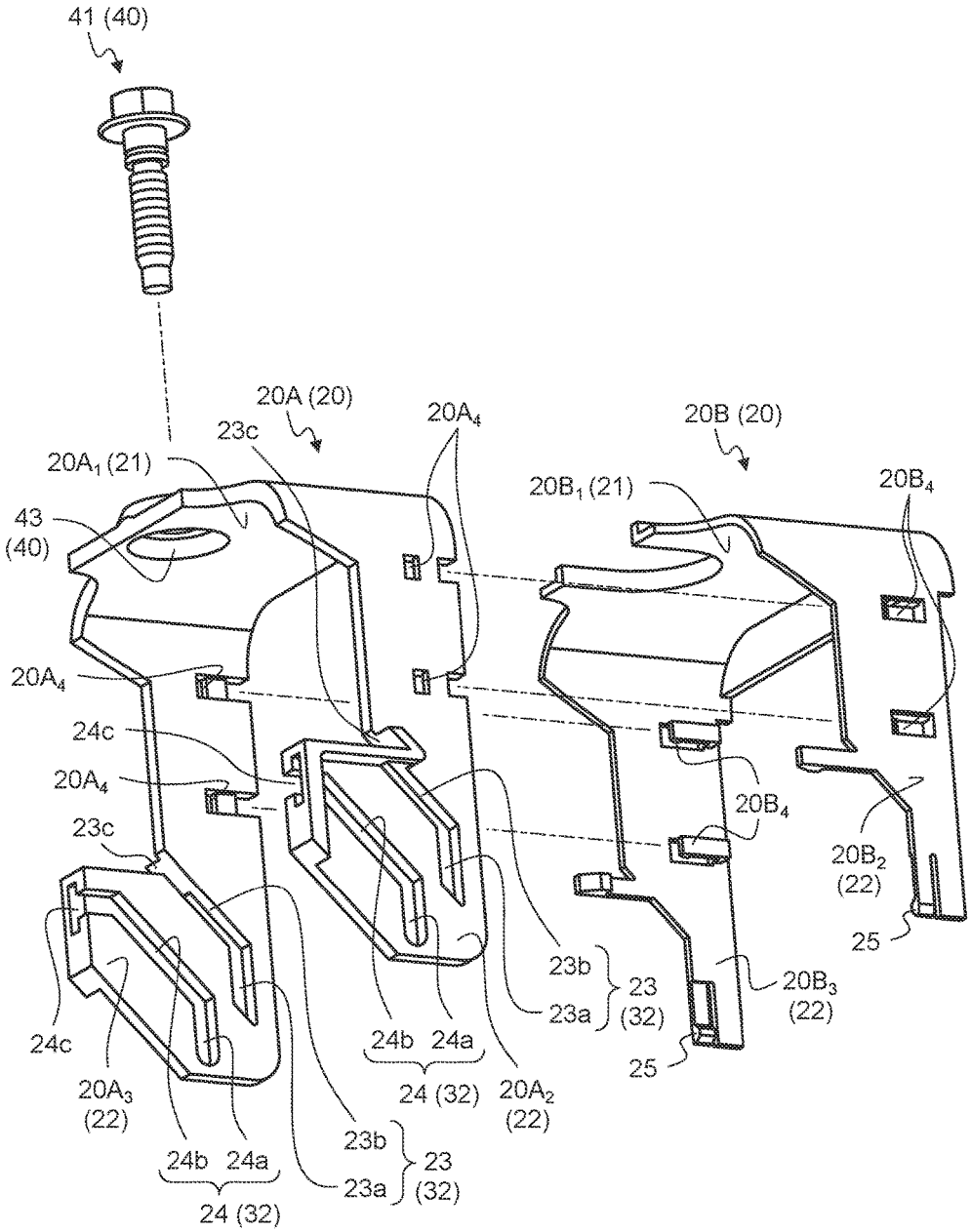
FIG. 6 is an exploded perspective view of the lever viewed from another direction.

More specifically, the lever 20 of this exemplification is prepared as an integrated structure in which a U-shaped first lever member 20A and a U-shaped second lever member 20B are assembled to each other (FIGS. 5 and 6). The first lever member 20A includes a base wall 20$A_1$, and two vertical walls 20$A_2$ and 20$A_3$ protruding in the same direction from two facing sides of the base wall 20$A_1$. Similarly to this, the second lever member 20B includes a base wall 20$B_1$, and two vertical walls 20$B_2$ and 20$B_3$ protruding in the same direction from two facing sides of the base wall 20$B_1$. In the lever 20, the base wall 21 is formed by the base walls 20$A_1$ and 20$B_1$ overlapped with each other, the one vertical wall 22 is formed by the vertical walls 20$A_2$ and 20$B_2$ overlapped with each other, and the other vertical wall 22 is formed by the vertical walls 20$A_3$ and 20$B_3$ overlapped with each other.

The first lever member 20A and the second lever member 20B are integrated by engaging a latch claw provided on one of these, with a wall surface of a latch claw provided on the other. In this exemplification, latch holes 20$A_4$ are provided in the first lever member 20A, and latch claws 20$B_4$ are provided in the second lever member 20B. The pair of latch hole $20A_4$ and latch claw $20B_4$ are provided at each of two locations on the vertical wall $20A_2$ and the vertical wall $20B_2$ that are facing each other, and are also provided at each of two locations on the vertical wall $20A_3$ and the vertical wall $20B_3$ that are facing each other.

The lever-fitting type connector 1 includes the first guide mechanism 30 that guides relative movement between the terminal accommodation member 10 and the lever 20 (FIGS. 1 to 3). The first guide mechanism 30 is configured to be able to convert lever input acting along the lever operation direction that is exerted from the lever 20 on the terminal accommodation member 10, into force in a connector insertion-removal direction intersecting with the lever operation direction, and to guide relative movement between the terminal accommodation member 10 and the lever 20 while performing conversion of the direction of the force. Furthermore, the lever-fitting type connector 1 includes a second guide mechanism 40 (FIGS. 1 to 3) that relatively moves the lever 20 with respect to the electrically-connected target object 110 while guiding the lever 20 in the lever operation direction. The second guide mechanism 40 is configured to enable the first guide mechanism 30 to exert lever input acting along the lever operation direction, on the terminal accommodation member 10 from the lever 20, by exerting force acting along the lever operation direction, on the lever 20, and relatively moving the lever 20 on which the force is exerted, with respect to the electrically-connected target object 110. The first guide mechanism 30 and the second guide mechanism 40 regulate a direction of each relative movement between the terminal accommodation member 10, the lever 20, and the electrically-connected target object 110, and by relatively moving the lever 20 in the lever operation direction in a state in which the connector fitting portion 12 and the counterpart fitting portion 101*a* are inserted, relatively move the terminal accommodation member 10 with respect to the electrically-connected target object 110 in the connector insertion-removal direction.

More specifically, the first guide mechanism 30 includes a guided portion 31 provided on one of the terminal accommodation member 10 and the lever 20, and a guiding portion 32 that is provided on the other one thereof, and guides the guided portion 31 while converting force in the lever operation direction that acts between the guided portion 31, into force in an orthogonal direction of the lever operation direction (FIGS. 1 to 4). The first guide mechanism 30 of this exemplification includes the guided portion 31 provided on the terminal accommodation member 10, and the guiding portion 32 provided on the lever 20. Thus, the first guide mechanism 30 is configured to guide the guided portion 31 along the guiding portion 32 while converting lever input in the lever operation direction that is exerted from the guiding portion 32 on the guided portion 31, into force in an orthogonal direction of the lever operation direction. At least one first guide mechanism 30 is provided between one vertical wall 22 in the lever 20 and the vertical wall $10B_4$ of the shield shell 10B, and at least one first guide mechanism 30 is provided between the other vertical wall 22 in the lever 20 and the vertical wall $10B_5$ of the shield shell 10B. In this exemplification, two first guide mechanisms 30 are provided at each location.

The guided portions 31 are provided on each of the vertical walls $10B_4$ and $10B_5$ of the shield shell 10B. For example, on each of the vertical walls $10B_4$ and $10B_5$, first and second protruding members 14 and 15 protruding toward the vertical wall 22 of the lever 20 that is opposed thereto (FIGS. 1 to 4). Here, each of the first and second protruding members 14 and 15 is used as the guided portion 31. The first protruding member 14 of the vertical wall $10B_4$ and the first protruding member 14 of the vertical wall $10B_5$ are protruding concentrically with each other in the second orthogonal direction toward directions opposite to each other. In addition, the second protruding member 15 of the vertical wall $10B_4$ and the second protruding member 15 of the vertical wall $10B_5$ are protruding concentrically with each other in the second orthogonal direction toward directions opposite to each other.

The guiding portions 32 are provided on the respective vertical walls 22 of the lever 20. On each of the vertical walls 22, first and second through-holes 23 and 24 are formed (FIGS. 5 and 6). Here, each of the first and second through-holes 23 and 24 is used as the guiding portion 32. Thus, the first and second through-holes 23 and 24 are formed such that the guided portions 31 are individually inserted thereinto, and the guided portions 31 are guided in a relative movement between the terminal accommodation member 10 and the lever 20. The first and second through-holes 23 and 24 are formed as long holes extending along a guiding direction of the guided portions 31, and each have two side walls extending along the guiding direction, and facing each other. The first through-holes 23 provided on the respective vertical walls 22 are formed to have the same shape and to face each other in the second orthogonal direction. In addition, the second through-holes 24 provided on the respective vertical walls 22 are formed to have the same shape and to face each other in the second orthogonal direction. In this exemplification, the first and second through-holes 23 and 24 are formed on each of the vertical walls $20A_2$ and $20A_3$ of the first lever member 20A.

The first through-hole 23 guides the first protruding member 14, and includes a first guide hole 23*a* that guides the first protruding member 14 in the first orthogonal direction, and a second guide hole 23*b* that guides the first protruding member 14 when the terminal accommodation member 10 is moved in the connector insertion-removal direction. Another end of the first guide hole 23*a* that is disposed on the base wall 21 side of one end thereof is communicated with one end of the second guide hole 23*b*. The second guide hole 23*b* is a long hole extending from the one end toward the counterpart connector 100 side and the base wall 21 side, and brings one side wall into contact with the first protruding member 14, and guides the first protruding member 14 along the side wall, in a relative movement of the lever 20 with respect to the terminal accommodation member 10.

At a contact point between the side wall of the second guide hole 23*b* and the first protruding member 14, when lever input acting along the lever operation direction is exerted, force in a normal direction (normal force) corresponding to the lever input is generated. In the lever-fitting type connector 1, the lever operation directions are regulated by the second guide mechanism 40 to orthogonal directions of the connector insertion-removal direction. Thus, in a state in which the connector fitting portion 12 and the counterpart fitting portion 101*a* are inserted, one of component forces of the normal force becomes force in an orthogonal direction of the lever operation direction (i.e., connector insertion-removal direction), to act on the first protruding member 14 from the side wall of the second guide hole 23*b*. Thus, the lever-fitting type connector 1 can move the terminal accommodation member 10 in the connector insertion-removal direction by moving the lever 20 in the lever operation direction.

The second through-hole 24 guides the second protruding member 15, and includes a first guide hole 24*a* that guides the second protruding member 15 in the first orthogonal direction, and a second guide hole 24*b* that guides the second protruding member 15 when the terminal accommodation member 10 is moved in the connector insertion-removal direction. The first guide hole 24*a* is equivalent to the first guide hole 23*a* of the first through-hole 23. The second guide hole 24*b* is equivalent to the second guide hole 23*b* of the first through-hole 23. Thus, specific description of the second through-hole 24 will be omitted here.

Next, a specific example of the second guide mechanism 40 will be described. The second guide mechanism 40 is provided between the lever 20 and the electrically-connected target object 110. The second guide mechanism 40 is a screw mechanism that can exert axial force acting along the lever operation direction, on the lever 20, and is configured to relatively move the lever 20 with respect to the electrically-connected target object 110 while guiding the lever 20 in the lever operation direction, when exerting axial force on the lever 20 in a state in which the connector fitting portion 12 and the counterpart fitting portion 101*a* are inserted. For example, the second guide mechanism 40 includes a male screw provided on one of the lever 20 and the electrically-connected target object 110 in a state in which an axis line extends along the lever operation direction, and a female screw provided on the other one thereof, and to be screwed with the male screw.

In this exemplification, a male screw member 41 is provided on the lever 20 (FIGS. 1 to 3, 5 and 6), and a female screw portion 42 is provided on the casing 111 of the electrically-connected target object 110 (FIG. 1). The male screw member 41 is rotatably attached in a state in which a shaft portion is inserted into a through-hole 43 (FIGS. 5 and 6) provided on the base wall 21 of the lever 20. A head portion of the male screw member 41 is exposed to the outside so that a worker or the like can perform rotation such as screw fastening using a tool. In the second guide mechanism 40, by fastening the male screw member 41 into the female screw portion 42, the lever 20 relatively moves while moving close to the electrically-connected target object 110 in the lever operation direction, and by rotating the male screw member 41 in an opposite direction, the lever 20 relatively moves while moving away from the electrically-connected target object 110 in the lever operation direction. Thus, in the lever-fitting type connector 1, a rotating operation of the male screw member 41 corresponds to a lever operation of a worker or the like.

Here, the second guide mechanism 40 is configured to fix the lever 20 to the electrically-connected target object 110 in conjunction with the completion of guiding of the lever 20 with respect to the electrically-connected target object 110. Thus, the male screw member 41 and the female screw portion 42 are configured to complete guiding of the lever 20 with respect to the electrically-connected target object 110 in conjunction with the end of fastening performed therebetween (i.e., fixing of the lever 20 to the electrically-connected target object 110). In addition, the first guide mechanism 30 is configured to complete fitting between the connector fitting portion 12 and the counterpart fitting portion 101*a* when the guiding of the lever 20 that is performed by the second guide mechanism 40 is completed. With this configuration, the lever-fitting type connector 1 can complete fitting with the counterpart connector 100 until the end of the lever operation in a fastening direction of the male screw member 41.

An operation of the lever-fitting type connector 1 will be described below.

Figure 7:
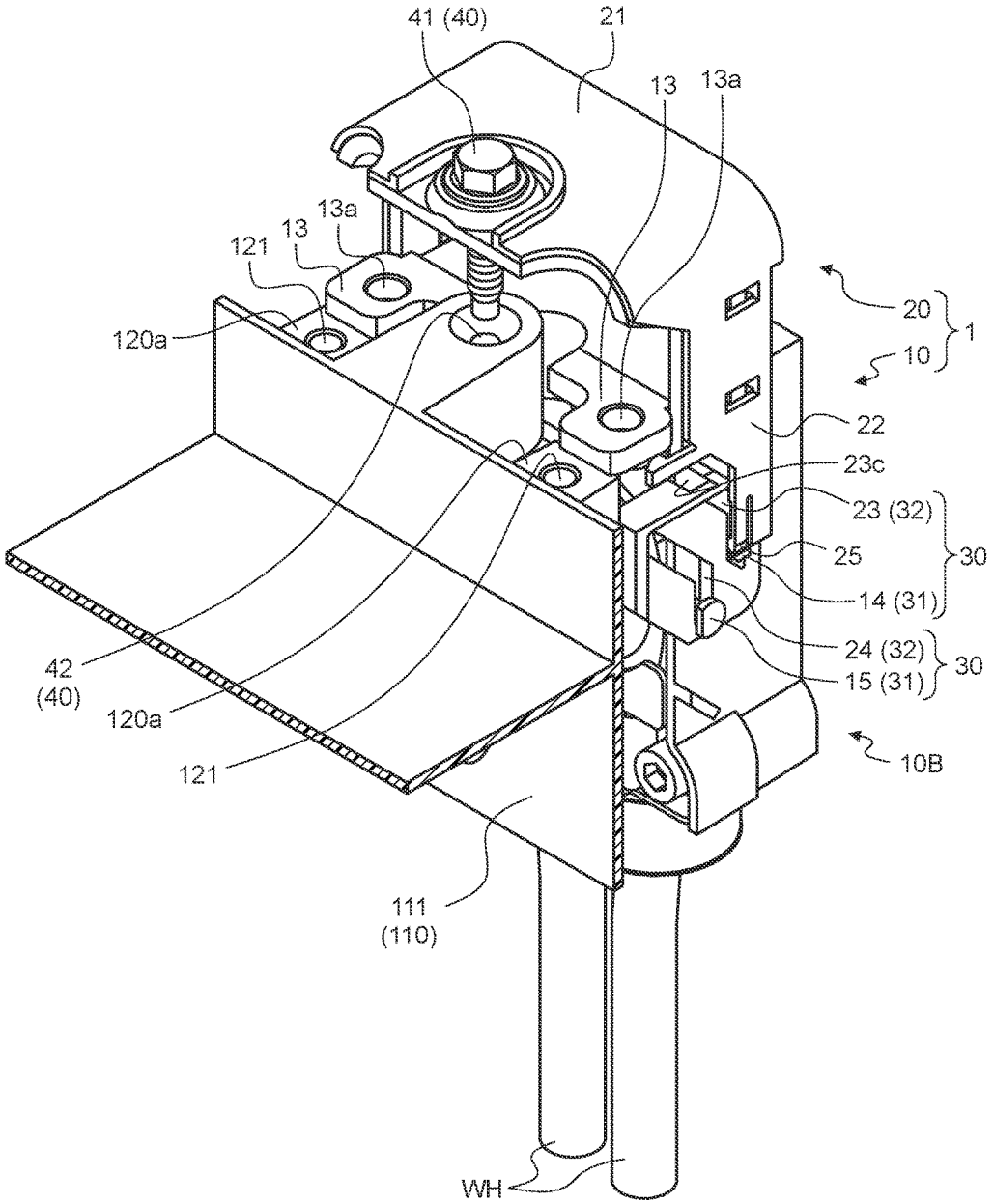
FIG. 7 is a perspective view illustrating a start state of attachment between the lever-fitting type connector and a counterpart connector.
Figure 8:
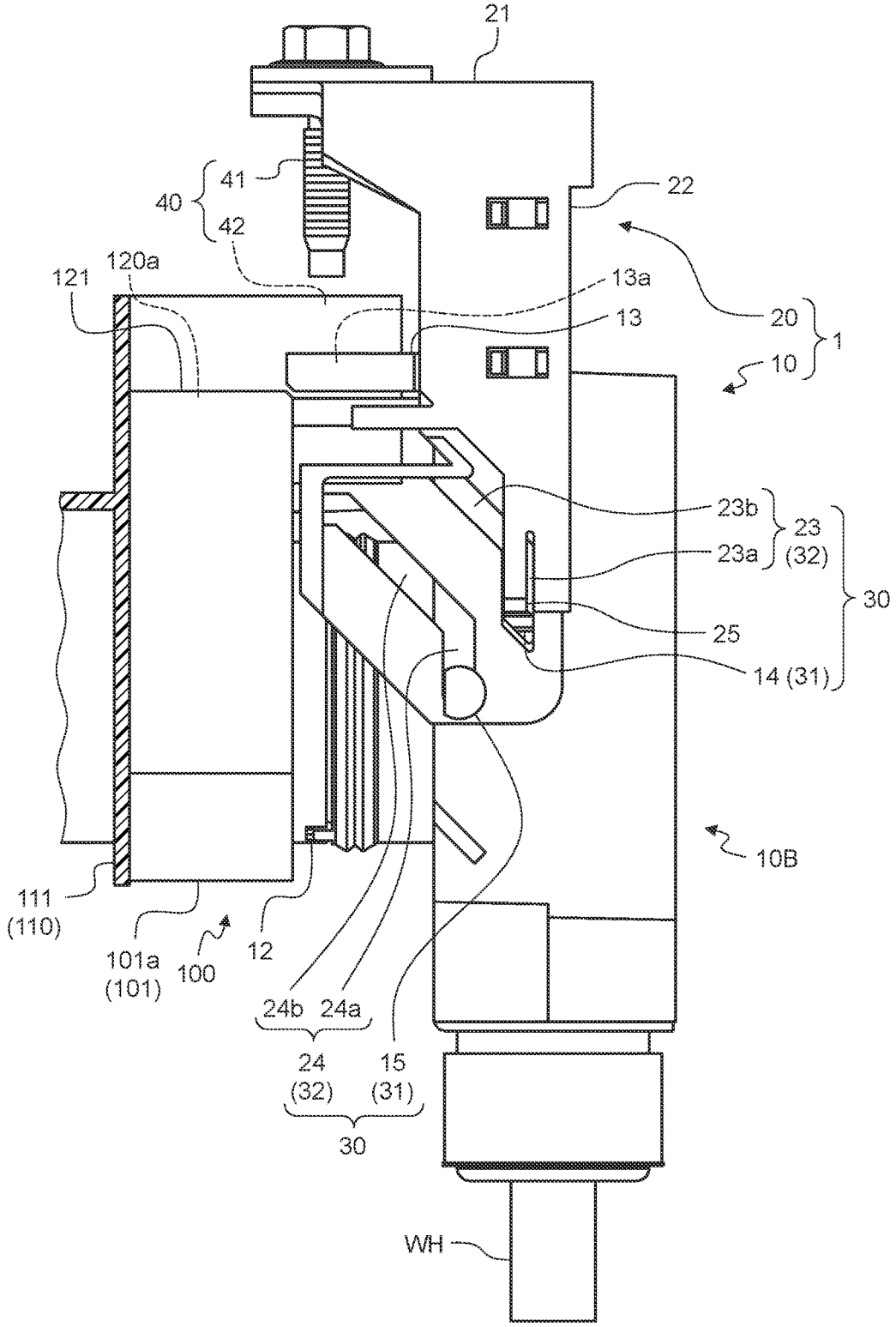
FIG. 8 is a side view illustrating a start state of attachment between the lever-fitting type connector and the counterpart connector.

In the lever-fitting type connector 1, the first protruding member 14 is inserted from an opening 23*c* (FIGS. 3, 5, and 6) on another end side of the second guide hole 23*b* in the first through-hole 23, and the second protruding member 15 is inserted from an opening 24*c* (FIGS. 3, 5, and 6) on another end side of the second guide hole 24*b* in the second through-hole 24, and the first protruding member 14 and the second protruding member 15 are guided to the respective one ends of the first guide hole 23*a* of the first through-hole 23 and the first guide hole 24*a* of the second through-hole 24. The lever 20 is thereby attached to the terminal accommodation member 10 (FIGS. 2, 7, and 8). Here, positional relationship between the terminal accommodation member 10 and the lever 20 becomes default positions set before the lever-fitting type connector 1 is attached to the counterpart connector 100. In the attachment, the first protruding member 14 reaches one end of the first guide hole 23*a* in the first through-hole 23 across a latch portion 25 of the lever 20, to be latched by the latch portion 25. With this configuration, in the lever-fitting type connector 1, a default position between the terminal accommodation member 10 and the lever 20 is maintained. The lever-fitting type connector 1 is attached to the counterpart connector 100 in a state of this default position.

Here, the latch portion 25 is provided on each of the vertical walls $\mathbf{20}B_2$ and $\mathbf{20}B_3$ of the second lever member 20B. The latch portions 25 are each formed as a claw portion provided at a leading end of a rectangular piece having flexibility, and are disposed so as to face the first guide holes 23*a* in the second orthogonal direction.

In the lever-fitting type connector 1, in a state in which the terminal accommodation member 10 and the lever 20 are at the default positions, a leading end of the connector fitting portion 12 is inserted into the counterpart fitting portion 101*a* by a worker or the like until the male screw member 41 is disposed concentrically with the female screw portion 42 (FIGS. 7 and 8).

Figure 9:
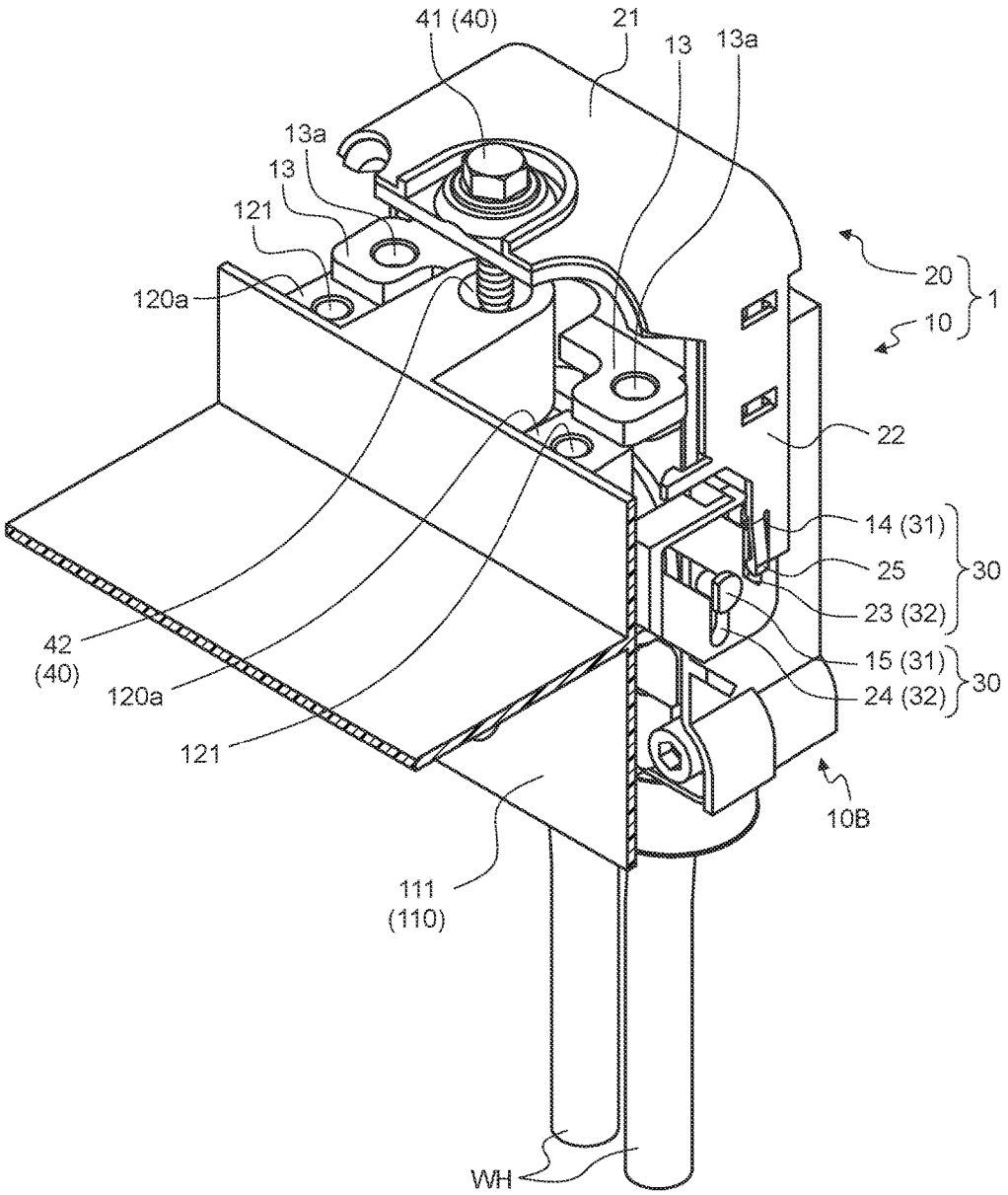
FIG. 9 is a perspective view illustrating a halfway state of attachment between the lever-fitting type connector and the counterpart connector, and is a diagram illustrating a start position of a lever operation.
Figure 10:
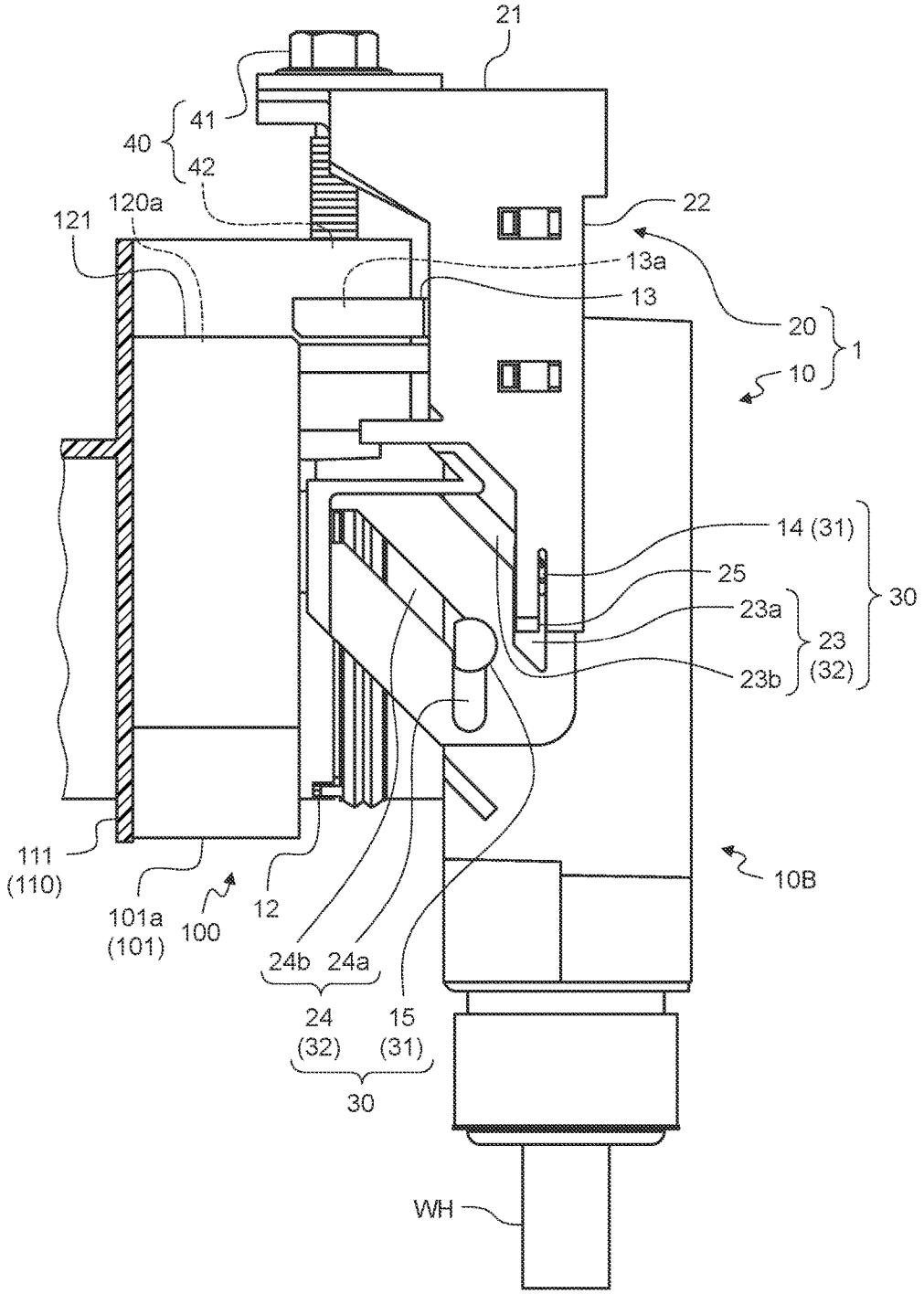
FIG. 10 is a side view illustrating a halfway state of attachment between the lever-fitting type connector and the counterpart connector, and is a diagram illustrating a start position of a lever operation.

Here, the male screw member 41 is disposed at a position distant from the female screw portion 42 in an inserted state, for enhancing workability in insertion. Thus, even if the male screw member 41 is rotated around an axis, the male screw member 41 cannot be screwed into the female screw portion 42. Thus, in the lever-fitting type connector 1, a worker or the like pushes the base wall 21 of the lever 20 toward the terminal accommodation member 10 up to a position where the male screw member 41 and the female screw portion 42 can be screwed. In the lever-fitting type connector 1, together with the pushing operation of the lever 20, the first protruding member 14 crosses over the latch portion 25 in a direction opposite to that in the aforementioned attachment, and the first protruding member 14 and the second protruding member 15 are guided to the respective other ends along the first guide hole 23*a* of the first through-hole 23 and the first guide hole 24*a* of the second through-hole 24 (FIGS. 9 and 10). Thus, in the lever-fitting type connector 1, respective lengths in the guiding direction of the first guide holes 23*a* and 24*a* are desirably decided so that the male screw member 41 and the female screw portion 42 become a screwable state when the guiding to the other ends is completed.

Figure 11:
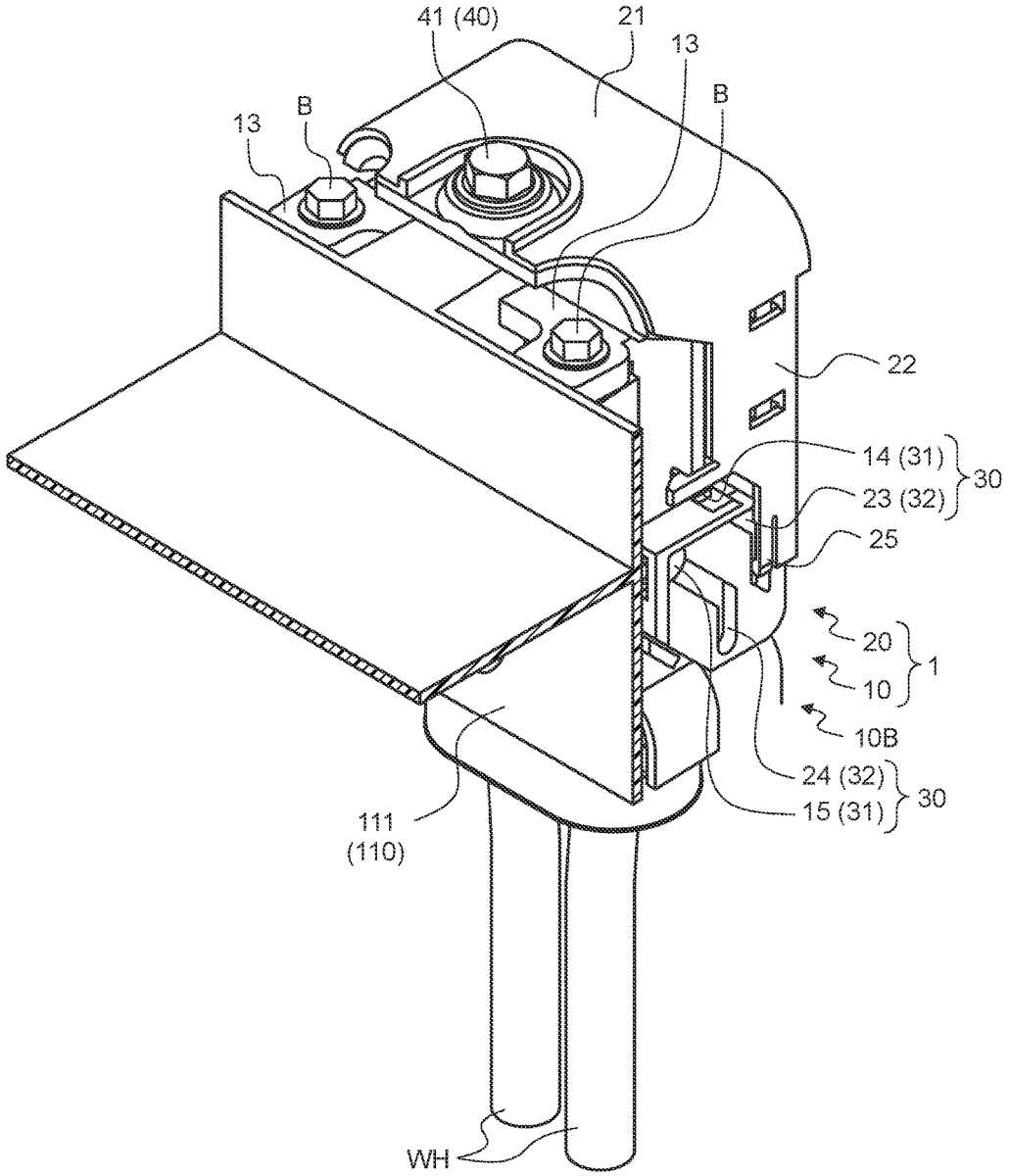
FIG. 11 is a perspective view illustrating a completed state of attachment between the lever-fitting type connector and the counterpart connector.
Figure 12:
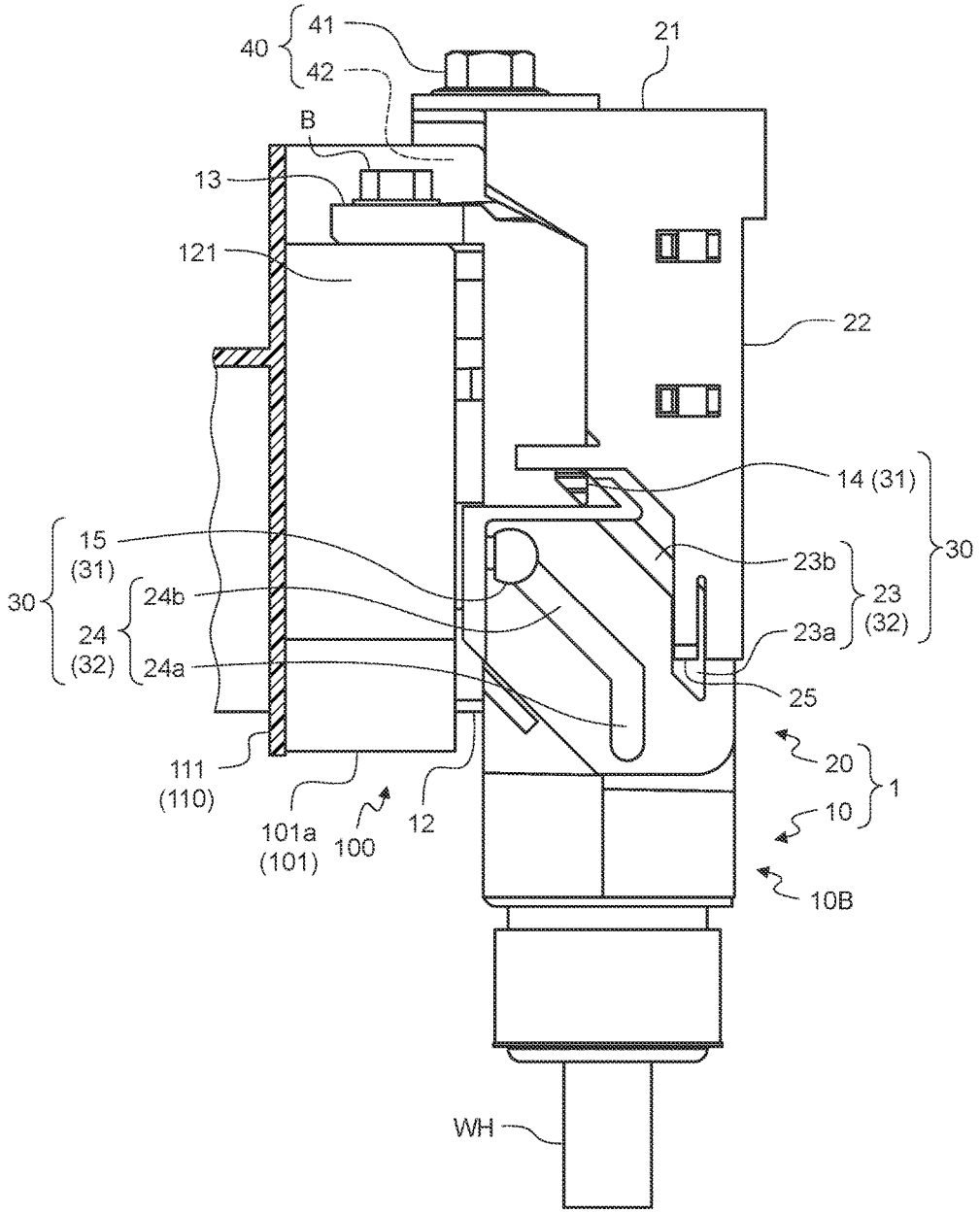
FIG. 12 is a side view illustrating a completed state of attachment between the lever-fitting type connector and the counterpart connector.

In the lever-fitting type connector 1, by a worker or the like rotating the male screw member 41 around an axis, and fastening into the female screw portion 42, axial force acting along the lever operation direction of the male screw member 41 is exerted on the lever 20, and lever input acting along the lever operation direction from the lever 20 is converted via the first guide mechanism 30 into force in a connector insertion direction. Thus, in the lever-fitting type connector 1, the terminal accommodation member 10 relatively moves with respect to the electrically-connected target object 110 in the connector insertion direction while the force conversion is being performed and the lever 20 is relatively moving in the lever operation direction so as to move close to the electrically-connected target object 110. At this time, the first protruding member 14 and the second protruding member 15 are guided to the respective other ends along the second guide hole 23*b* of the first through-hole 23 and the second guide hole 24*b* of the second through-hole 24. In the lever-fitting type connector 1 of this exemplification, when the first protruding member 14 and the second protruding member 15 are guided to the respective other ends of the second guide holes 23*b* and 24*b*, fastening of the male screw member 41 with respect to the female screw portion 42 ends, and fitting of the connector fitting portion 12 with respect to the counterpart fitting portion 101*a* is completed (FIGS. 11 and 12). The length, the angle with respect to the lever operation direction or the connector insertion-removal direction, and the like of each of the second guide holes 23*b* and 24*b* are decided so as to implement these operations.

The lever-fitting type connector 1 is attached to the counterpart connector 100 by thus completing fitting of the connector fitting portion 12 and the counterpart fitting portion 101*a*. After the lever-fitting type connector 1 is attached to the counterpart connector 100, the lever-fitting type connector 1 is fixed to the casing 111 of the electrically-connected target object 110 by inserting the male screw members B into the hole portions 13*a* of the respective fixed portions 13, and screwing into the female screw portions of the fixing portions 120.

On the other hand, when the lever-fitting type connector 1 is detached from the counterpart connector 100, the male screw members B are detached, and the male screw member 41 of the lever 20 is rotated around an axis in a direction opposite to that in the attachment.

For example, in the lever-fitting type connector 1, by exerting axial force on the lever 20 together with the inverse rotation of the male screw member 41, the lever 20 may be relatively moved with respect to the electrically-connected target object 110 in a direction opposite to that in the attachment. In this case, in the lever-fitting type connector 1, axial force acting along the lever operation direction of the male screw member 41 is exerted on the lever 20, and lever input acting along the lever operation direction from the lever 20 is converted via the first guide mechanism 30 into force in a connector removal direction. Then, in the lever-fitting type connector 1, the terminal accommodation member 10 relatively moves with respect to the electrically-connected target object 110 in the connector removal direction while the force conversion is being performed and the lever 20 is relatively moving in the lever operation direction so as to move away from the electrically-connected target object 110. At this time, the first protruding member 14 and the second protruding member 15 are guided to the respective one ends along the second guide hole 23*b* of the first through-hole 23 and the second guide hole 24*b* of the second through-hole 24. In the lever-fitting type connector 1, together with the guiding of the first protruding member 14 and the second protruding member 15, a fitted state of the connector fitting portion 12 and the counterpart fitting portion 101*a* is released. Then, the connector fitting portion 12 is removed from the counterpart fitting portion 101*a* to a position where a leading end is inserted. The lever-fitting type connector 1 is detached from the counterpart connector 100 by being pulled out from the counterpart connector 100 in the state.

In addition, in the lever-fitting type connector 1, together with the inverse rotation of the male screw member 41, axial force may not be exerted on the lever 20. In this case, after screwing of the male screw member 41 with the female screw portion 42 is released, by a worker or the like pulling the base wall 21 so that the lever 20 relatively moves with respect to the electrically-connected target object 110 in a direction opposite to that in the attachment, a fitted state of the connector fitting portion 12 and the counterpart fitting portion 101*a* is released, and the connector fitting portion 12 is removed from the counterpart fitting portion 101*a* to the position where the leading end is inserted. After that, the lever-fitting type connector 1 is detached from the counterpart connector 100 by being pulled out from the counterpart connector 100.

Meanwhile, in the lever-fitting type connector 1 and the counterpart connector 100, if the connector fitting portion 12 and the counterpart fitting portion 101*a* support each other during a period until the male screw member 41 starts to be screwed into the female screw portion 42, or when the screwing is started, in connector insertion, they may incline with respect to each other in the connector insertion direction by a clearance gap between the connector fitting portion 12 and the counterpart fitting portion 101*a* (clearance gap provided considering workability at the time of connector insertion and removal). In addition, when the male screw member 41 starts to be screwed into the female screw portion 42, the inclination with respect to each other may cause biting between the male screw member 41 and the female screw portion 42, and cause sliding while the connector fitting portion 12 and the counterpart fitting portion 101*a* remain inclined with respect to each other, and may decline workability of connector insertion. In addition, in the lever-fitting type connector 1 and the counterpart connector 100, if the connector fitting portion 12 and the counterpart fitting portion 101*a* support each other subsequently to a time immediately before a screwed state of the male screw member 41 and the female screw portion 42 is released in connector removal, they may incline with respect to each other in the connector removal direction by a clearance gap between the connector fitting portion 12 and the counterpart fitting portion 101*a*. The inclination with respect to each other that is generated at the time may similarly cause biting between the male screw member 41 and the female screw portion 42, and cause sliding while the connector fitting portion 12 and the counterpart fitting portion 101*a* remain inclined with respect to each other, and may decline workability of connector removal.

Thus, the lever-fitting type connector 1 includes, between the counterpart connector 100, a holding mechanism (hereinafter, referred to as an "orientation holding mechanism") 50 (FIG. 13) for holding an orientation at the time of connector insertion and removal with respect to the counterpart connector 100, so as to extend along the connector insertion-removal direction. The orientation holding mechanism 50 includes a latch portion 51 provided on one of the terminal accommodation member 10 and the counterpart connector 100, and a latched portion 52 that is provided on the other one thereof, and is latched by the latch portion 51 in a state in which the orientation of the connector fitting portion 12 with respect to the counterpart fitting portion 101*a* at least at the time of connector insertion and removal is held so as to extend along the connector insertion-removal direction. In other words, the orientation holding mechanism 50 is provided with the latch portion 51 and the latched portion 52 such that, at least at the time of connector insertion and removal, a state in which the respective cylindrical axis directions of the connector fitting portion 12 and the counterpart fitting portion 101*a* match is held. In this exemplification, the latch portion 51 is provided on the counterpart connector 100, and the latched portion 52 is provided on the terminal accommodation member 10. In addition, in this exemplification, a combination of the latch portion 51 and the latched portion 52 is provided at each of two locations.

Figure 13:
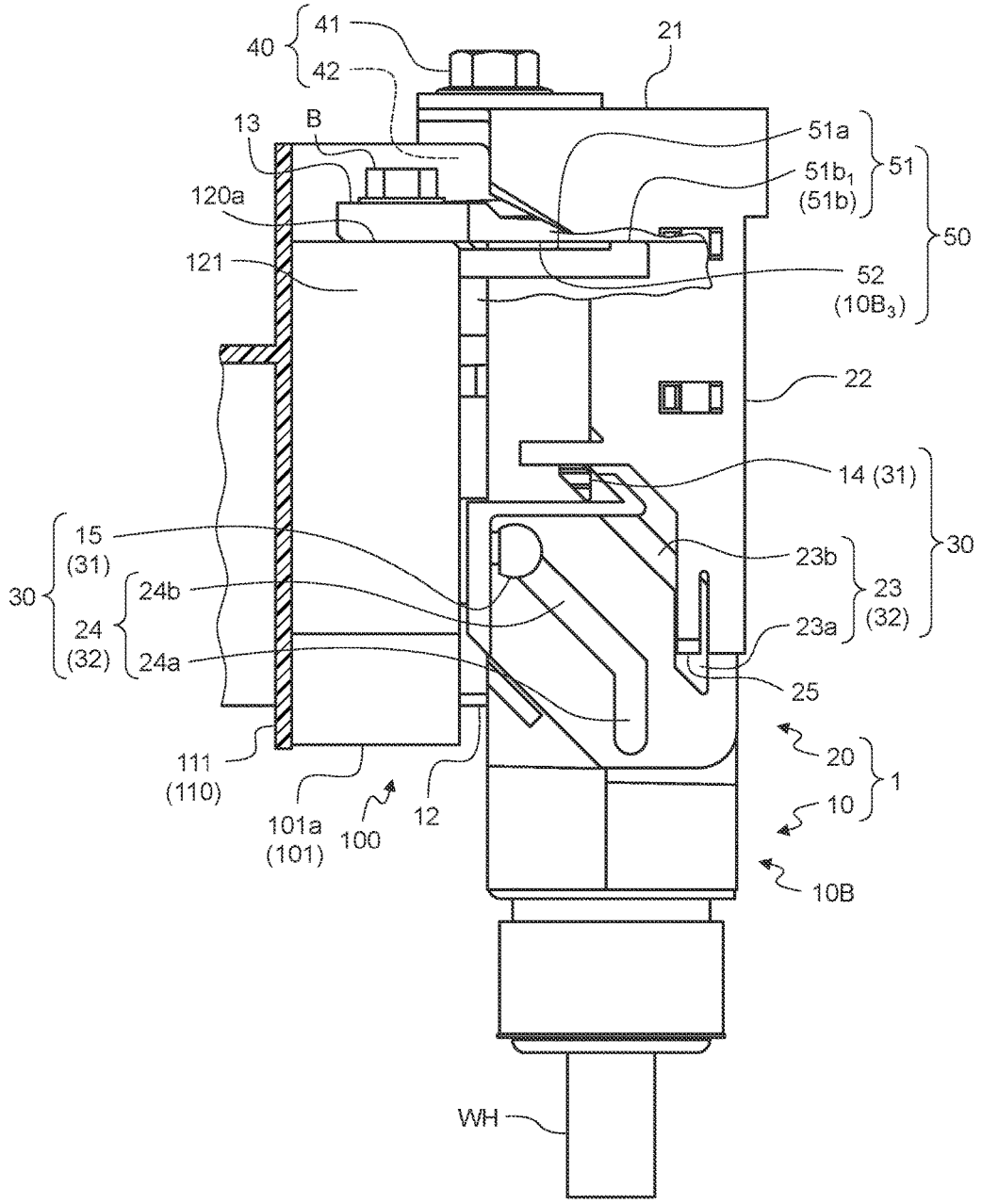
FIG. 13 is a partial cross-sectional view illustrating an orientation holding mechanism.

The latch portion 51 of this exemplification includes a piece 51*a* extending from the fixing portion 120 in the connector insertion-removal direction, and protruding toward the lever-fitting type connector 1 side, and a latch member 51*b* having an end surface $51b_1$ disposed on the same plane as the end surface 120*a* of the fixing portion 120 (FIGS. 1 and 13). The latch portion 51 is provided for each of the fixing portions 120. After the completion of fitting of the connector fitting portion 12 and the counterpart fitting portion 101*a*, the latch portion 51 is accommodated inside the shield shell 10B. Thus, the latched portion 52 is provided inside the shield shell 10B. In this exemplification, the fixed portion 13 overlapped with the end surface 120*a* of the fixing portion 120 protrudes from the vertical wall $10B_3$ of the shield shell 10B. The latched portion 52 is therefore provided on the vertical wall $10B_3$. Here, an inner wall surface of the vertical wall $10B_3$ is used as the latched portion 52. Thus, the inner wall surface of the vertical wall $10B_3$ is a plane on which at least a portion on which the latch member 51*b* slides extends along the connector insertion-removal direction, and is formed so as to be disposed on the same plane as the plane of the fixed portion 13 overlapped with the end surface 120*a* of the fixing portion 120.

In the lever-fitting type connector 1, at the time of connector insertion and removal, the latched portion 52 is latched by the latch member 51*b* of the latch portion 51, and the orientation of the connector fitting portion 12 with respect to the counterpart fitting portion 101*a* is held so as to extend along the connector insertion-removal direction. Thus, the lever-fitting type connector 1 can enhance workability at the time of connector insertion and removal.

As described above, in the lever-fitting type connector 1 of the present embodiment, the lever 20 is attached to the terminal accommodation member 10 such that a linear lever operation is performed, and the aforementioned first guide mechanism 30 is interposed between the terminal accommodation member 10 and the lever 20, and the aforementioned second guide mechanism 40 is interposed between the lever 20 and the electrically-connected target object 110. Thus, when exerting lever input acting along the lever operation direction, from the lever 20 on the terminal accommodation member 10, the lever-fitting type connector 1 can exert force in the connector insertion-removal direction, on the terminal accommodation member 10. The lever-fitting type connector 1 therefore can fit the connector fitting portion 12 with the counterpart fitting portion 101*a* while relatively moving the connector fitting portion 12 with respect to the counterpart fitting portion 101*a* in the connector insertion-removal direction. In other words, the lever-fitting type connector 1 can fit the connector fitting portion 12 with the counterpart fitting portion 101*a* even without providing a clearance gap as large as that in the conventional technique, between the connector fitting portion 12 and the counterpart fitting portion 101*a*. Thus, the lever-fitting type connector 1 can achieve miniaturization of a physical size more than the conventional technique.

In the lever-fitting type connector according to the present embodiment, the lever is attached to the terminal accommodation member such that a linear lever operation is performed, and the aforementioned first guide mechanism is interposed between the terminal accommodation member and the lever, and the aforementioned second guide mechanism is interposed between the lever and the electrically-connected target object. Thus, when exerting lever input acting along the lever operation direction, from the lever on the terminal accommodation member, the lever-fitting type connector can exert force in the connector insertion-removal direction, on the terminal accommodation member. The lever-fitting type connector therefore can fit the connector fitting portion with the counterpart fitting portion while relatively moving the connector fitting portion with respect to the counterpart fitting portion in the connector insertion-removal direction. In other words, the lever-fitting type connector can fit the connector fitting portion with the counterpart fitting portion even without providing a clearance gap as large as that in the conventional technique, between the connector fitting portion and the counterpart fitting portion. Thus, the lever-fitting type connector can achieve miniaturization of a physical size more than the conventional technique.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lever-fitting type connector comprising:

a terminal accommodation member including a terminal accommodation unit accommodating a terminal serving as a target of fitting with a counterpart terminal of a counterpart connector in an electrically-connected target object, and a connector fitting portion to be fitted with a counterpart fitting portion of the counterpart connector;

a lever configured to linearly perform a relative movement with respect to the terminal accommodation member when lever operational force in a straight direction is input;

a first guide mechanism configured to convert lever input acting along a lever operation direction that is exerted from the lever on the terminal accommodation member, into force in a connector insertion-removal direction orthogonal to the lever operation direction, and to guide a relative movement between the terminal accommodation member and the lever while performing conversion of a direction of the force; and a second guide mechanism that is a screw mechanism that can exert axial force acting along the lever operation direction, on the lever, and is configured to relatively move the lever with respect to the electrically-connected target object while guiding in the lever operation direction, when exerting the axial force on the lever in a state in which the connector fitting portion and the counterpart fitting portion are inserted.

2. The lever-fitting type connector according to claim 1, wherein the second guide mechanism is configured to fix the lever to the electrically-connected target object in conjunction with completion of guiding of the lever with respect to the electrically-connected target object, and the first guide mechanism is configured to complete fitting between the connector fitting portion and the counterpart fitting portion when guiding of the lever that is performed by the second guide mechanism is completed.

3. The lever-fitting type connector according to claim 1, wherein the first guide mechanism includes a guided portion provided on one of the terminal accommodation member and the lever, and a guiding portion that is provided on another one thereof and guides the guided portion while converting force in the lever operation direction that acts with the guided portion into force in an orthogonal direction of the lever operation direction.

4. The lever-fitting type connector according to claim 1, wherein the second guide mechanism includes a male screw provided on one of the lever and the electrically-connected target object in a state in which an axis line extends along the lever operation direction, and a female screw provided on another one thereof and to be screwed with the male screw.

5. The lever-fitting type connector according to claim 1, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

6. The lever-fitting type connector according to claim 2, wherein the first guide mechanism includes a guided portion provided on one of the terminal accommodation member and the lever, and a guiding portion that is provided on another one thereof and guides the guided portion while converting force in the lever operation direction that acts with the guided portion into force in an orthogonal direction of the lever operation direction.

7. The lever-fitting type connector according to claim 2, wherein the second guide mechanism includes a male screw provided on one of the lever and the electrically-connected target object in a state in which an axis line extends along the lever operation direction, and a female screw provided on another one thereof and to be screwed with the male screw.

8. The lever-fitting type connector according to claim 2, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

9. The lever-fitting type connector according to claim 3, wherein the second guide mechanism includes a male screw provided on one of the lever and the electrically-connected target object in a state in which an axis line extends along the lever operation direction, and a female screw provided on another one thereof and to be screwed with the male screw.

10. The lever-fitting type connector according to claim 3, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

11. The lever-fitting type connector according to claim 4, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

12. The lever-fitting type connector according to claim 6, wherein the second guide mechanism includes a male screw provided on one of the lever and the electrically-connected target object in a state in which an axis line extends along the lever operation direction, and a female screw provided on another one thereof and to be screwed with the male screw.

13. The lever-fitting type connector according to claim 6, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

14. The lever-fitting type connector according to claim 7, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

15. The lever-fitting type connector according to claim 9, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

16. The lever-fitting type connector according to claim 12, further comprising:

an orientation holding mechanism for holding an orientation with the counterpart connector at a time of connector insertion and removal with respect to the counterpart connector in the connector insertion-removal direction, wherein the orientation holding mechanism includes a latch portion provided on one of the terminal accommodation member and the counterpart connector, and a latched portion that is provided on another one thereof, and is latched by the latch portion in a state in which the orientation of the connector fitting portion with respect to the counterpart fitting portion at least at a time of connector insertion and removal is held in the connector insertion-removal direction.

* * * * *